US011377789B2

(12) United States Patent
Selwyn et al.

(10) Patent No.: US 11,377,789 B2
(45) Date of Patent: Jul. 5, 2022

(54) WATER-FREE FABRIC DYEING PROCESS AND DYE COMPOSITIONS

(71) Applicant: Green Theme Technologies Inc., Albuquerque, NM (US)

(72) Inventors: Gary S. Selwyn, Albuquerque, NM (US); Chris B. Cooper, Albuquerque, NM (US); Aaron T. Caudill, Albuquerque, NM (US)

(73) Assignee: Green Theme Technologies Inc., Rio Rancho, NM (US)

( * ) Notice: Subject to any disclaimer, the term of this patent is extended or adjusted under 35 U.S.C. 154(b) by 96 days.

(21) Appl. No.: 16/664,230

(22) Filed: Oct. 25, 2019

(65) Prior Publication Data

US 2021/0123186 A1 Apr. 29, 2021

(51) Int. Cl.

| | |
|---|---|
| ***D06P 5/20*** | (2006.01) |
| ***D06P 1/52*** | (2006.01) |
| ***D06P 1/653*** | (2006.01) |

(52) U.S. Cl.

CPC ..... *D06P 5/2077* (2013.01); *D06P 1/5292* (2013.01); *D06P 1/653* (2013.01)

(58) Field of Classification Search

CPC ..... D06P 5/2077; D06P 1/5292; D06P 1/653
See application file for complete search history.

(56) References Cited

U.S. PATENT DOCUMENTS

| | | | | |
|---|---|---|---|---|
| 3,504,996 | A | 4/1970 | McMullen | |
| 3,957,427 | A | 5/1976 | Chambers | |
| 4,132,522 | A | 1/1979 | Fono | |
| 4,448,582 | A | 5/1984 | Johnson | |
| 7,731,763 | B2 | 6/2010 | Fernandez Cid | |
| 8,870,972 | B2 | 10/2014 | Grier | |
| 2001/0036510 | A1* | 11/2001 | Engle | B41M 5/52 427/384 |
| 2008/0284804 | A1* | 11/2008 | Seccombe | H04N 1/1911 347/9 |
| 2010/0033524 | A1* | 2/2010 | Arai | C09D 11/324 347/9 |
| 2020/0140708 | A1* | 5/2020 | Shimoni | D06P 5/30 |

FOREIGN PATENT DOCUMENTS

| | | | |
|---|---|---|---|
| CN | 104278576 | A | 1/2015 |
| GB | 1270886 | A | 4/1972 |
| GB | 1274601 | A | 5/1972 |
| WO | 2015/127479 | A | 8/2015 |
| WO | 2017/020018 | A | 2/2017 |

OTHER PUBLICATIONS

MSDS Disperse Red 60, https://www.sigmaaldrich.com/US/en/sds/aldrich/s477648, Aug. 27, 2021.*

Isopropyl myristate; https://www.alfa-chemistry.com/product/isopropyl-myristate-cas-110-27-0-4563.html, Aug. 27, 2021.*

* cited by examiner

*Primary Examiner* — Amina S Khan

(57) ABSTRACT

A non-aqueous fabric dyeing method using a non-aqueous dyeing composition is described. The dyeing composition is a fluid at room temperature; contains no more than 5% water, no more than 5% VOCs and no more than 2.5% by weight vinyl monomers. The dye composition includes an organic dye that is solid at temperatures up to 130° C. and which sublimes or boils at 130 to 220° C., and further includes a carrier that is a liquid in the temperature range of 130 to 220° C.

13 Claims, No Drawings

WATER-FREE FABRIC DYEING PROCESS AND DYE COMPOSITIONS

The present invention relates to a fabric dying process, dye compositions, and a process for applying a hydrophobic coating onto dyed fabric.

It is often advantageous to apply a hydrophobic treatment to a fabric. Sportswear, rain gear, tents, tarpaulins and other fabrics that are frequently exposed to rainwater, snow and/or ice, or which otherwise need to repel water, are among the many examples of fabric articles that benefit from a hydrophobic treatment. The hydrophobic treatment helps the fabric to shed or repel water and water-based stains.

WO 2015/127479 and WO 2017/020018 describe certain hydrophobic treatments and methods for applying them to fabrics or other things. These hydrophobic treatments have been found to be very effective, imparting excellent hydrophobic (and sometimes oleophobic) properties, while preserving breathability. The applied hydrophobic treatment is quite resistant to repeated wash cycles.

Nonetheless, it has been discovered that hydrophobic fabric treatments, including those described in WO 2015/127479 and WO 2017/020018, as well as others, often perform inconsistently when applied to conventionally, water-based dyed fabrics. In particular, conventionally dyed fabrics require a subsequent rinse cycle to remove chemical constituents needed for water-based dyeing, such as emulsifiers, pH adjusters, wetting agents and fixing chemicals. Because these ancillary additives are made to work in water baths, they have a hydrophilic nature. If the dye process or the rinse step is abbreviated to save water or process time, traces of these hydrophilic chemicals may remain in the dyed fabric once it is dried. A subsequent application of hydrophobic chemistry for water-proofing will be compromised by this residue, resulting in an inferior water-repellent treatment. Although WO 2015/127479 and WO 2017/020018 mention that dyes can be added to their respective hydrophobic fabric treatments as a one-step process, it has been found that poor color saturation is obtained. The dyed fabrics have a pale or washed out appearance.

Dyeing mills are often resistant to performing the very thorough washing step due to in part to cost and equipment limitations, but also because a more thorough washing step creates a large amount of an aqueous waste stream that must be cleaned or disposed of. Additionally, waste water that contains dye is difficult to remediate and also can present a health hazard if it contaminates community drinking water.

In fact, waste generation and disposal is a very significant problem in the commercial fabric dyeing industry and for the textile industry at large. Large amounts of aqueous waste streams are generated not only in the post dyeing washing step, but in the dyeing process itself.

Fabrics are conventionally dyed in a process in which the fabric is immersed in an aqueous dye bath. The dyes for the most part are solid materials that do not dissolve in water. As such, they exhibit a strong tendency to settle out of the aqueous dye bath. This problem is mitigated by adding various chemicals such as surfactants, emulsifiers and thickeners to the dye bath, to keep the dye particles in suspension. Often, other chemicals are added as well, including various hydrophilic polymers (to make thermosols for thermsol dyeing) chelating agents, leveling agents, pH control agents, antifoaming agents, fixing chemicals and reducing agents. Many of these are water-soluble, water-dispersible or otherwise hydrophilic.

Conventional, water-based dyeing therefore generates large amounts of hazardous waste water and is done most commonly as a batch process. When the dyeing process is completed, or it is desired to change to a different dye, the dye bath is discarded and the dye vessel then must be cleaned to remove residual dye from the internal surfaces of the vessel. Cleaning of a water-based dye bath is highly labor intensive. Additional wastewater is generated when the dye bath is cleaned, as well as from the fabric rinse step.

Additionally, the inventors have learned that the rinsing step after dyeing, even if done correctly, can have deleterious effects on a subsequent hydrophobic finish if the rinse water contains a high, dissolved mineral content. Drying the fabric after exposure to "hard" water leads to a water-soluble, mineral residue on the fabric that will compromise a hydrophobic finish when over-coated. Accordingly, a dye process that can be done rinse-free is of much value.

The need to discharge large amounts of water waste is a very serious concern within the fabric dyeing industry. This concern becomes greater over time as government as well as non-governmental groups continue to push the industry towards low or zero-discharge manufacturing processes. Accordingly, the textile industry has identified water-free dyeing as a long-term goal for the industry.

The aqueous dyeing processes have other serious disadvantages. The dye bath becomes depleted of the dye periodically and so the dye must be replenished from time to time, especially if the dyebath is used to dye multiple batches of fabric. This must be done carefully, as changes in the characteristics of the dye bath, such as changes in dye concentration or pH, can affect the process and lead to inconsistent coloration. As the mineral content and pH of water varies in every location, each dye house needs to dial-in their process to adjust for differences in the water quality.

Prolonged batch times often are needed, especially when dying certain synthetic fabrics, such as nylon or polyester. It is often necessary to perform the dyeing step at elevated temperatures, such as 80° C. or in some cases even at 100-125 C. The need to use high temperatures vastly increases the energy requirements of the process, because large volumes of water must be heated. In cases in which the temperature is at or above the atmospheric pressure boiling temperature of water, it becomes necessary to pressurize the dyeing vat. This requires special equipment. In addition, the dyed, wet fabric next needs to be dried, which requires more energy to accomplish on an industrial scale.

CN 104278576A describes a hot-melt dyeing method using decamethylcyclopentasiloxane media, by immersing polyester fabric into a dye, then soaking the fabric in water, followed by taking out fabric, drying, adding pure disperse dye in media and placing the fabric in the dye bath.

References such as U.S. Pat. Nos. 3,504,996, 3,957,427, 4,132,522, 4,448,582, GB 1,270,886 and 1,274,601 describe various thermosol dyeing processes. Thermosol dyeing is an aqueous emulsion bath process in which the batch contains a small amount of an emulsified organic phase. The organic phase may contain, for example, a water-soluble organic polymer such as a urea-formaldehyde resin, a melamine-formaldehyde resin, a poly(vinyl methyl ether/maleic anhydride amide derivative) or a water-soluble polyglycol. A reducing agent such as a methyl hydrogen polysiloxane may be additionally be present. The thermosol dyeing process can be operated continuously by passing the fabric sequentially through a "padding station" where it is immersed in the thermosol dye bath and then through various heating stations to first dry the wetted fabric to remove water and then to "cure" the dye. The fabric is squeezed (padded) after immersion in the bath to remove excess liquids. Despite the advantage of being capable of continuous operation, the thermosol dyeing process has many of the same drawbacks as aqueous batch dyeing. Dye baths have to be replenished; unused bath solution must be discarded; much waste is generated in cleaning the equipment; energy is needed to remove water from the fabric; and post-dyeing fabric treatments are needed to remove residual chemicals and surface dyes.

There are known alternatives to aqueous bath or thermosol dyeing. For example, U.S. Pat. No. 7,731,763 describes a supercritical $CO_2$ dyeing process. Equipment for practicing this technology is offered commercially by DYCOO, Weesp, Netherlands. This process avoids many of the problems of using an aqueous bath, in that no water or surfactant is necessary and the dyed fabric does not need to be dried. However, it requires extremely expensive, high pressure equipment to handle the necessary operating pressures (up to 3000 psi), and post-dyeing fabric cleaning must be performed. This is also inherently a batch method.

Another alternative to aqueous bath dyeing is a transfer printing process. Transfer printing is a dry process that avoids the need for a bath. Instead, the dye is applied first to a transfer paper. This can be done, for example, using ink-jet printing or other digital printing methods. The transfer paper is then placed into contact with the fabric. The dye is transferred to the fabric under conditions of heat and mechanical pressure. The dye sublimates under such conditions to transfer the color to the fabric.

A continuous transfer printing process is described, for example, in U.S. Pat. No. 8,870,972. Sublimation dyes are applied to each of two transfer sheets. The textile to be colored is sandwiched between the transfer sheets. The sandwich assembly is then subjected to conditions of heat and mechanical pressure, as in a heat press. The dye sublimates to color the fabric.

As U.S. Pat. No. 8,870,972 makes clear, transfer printing is quite different from bath dyeing. The dye does not uniformly color the fabric. Instead, the dye is retained on and colors only the fabric surface. When the dye is applied to a side of a fabric, only that side becomes colored. Because of this, the process of U.S. Pat. No. 8,870,972 permits and in fact is specially adapted for producing fabrics with different colors and/or patterns on its opposing sides or single-sided coloration.

Additionally, printing is done using water-based dyes or inks. These are used because the use of water-insoluble dyes will complicate the use of subsequent finishing steps, such as the application of water-repellent finishes: the dyes will interfere with subsequent water-based finishing steps. Essentially, textile finishing can be done either by using water-compatible chemistry or water-incompatible chemistry. There is a strong desire to convert textile finishing, consisting of dyeing and water-repellent finishing, away from water-compatible chemistry to chemistry that is incompatible with water in order to achieve a highly water-repellent and laundry durable finishing treatment. In addition, a second goal is to eliminate water waste from dyeing operations, without creating any secondary pollution.

When the dye is applied only to the surface of the fabric, the color or pattern becomes easily susceptible to wear, unlike the case when the fabric is dyed in a bath. The hydrophobic nature of many synthetic fabrics means that water-based dyes or inks do not penetrate into the yarn and so produce only a surface coloration. In addition, the transfer printing process requires the use of transfer sheets, which add complexity and cost, particularly when it is attempted to operate a transfer printing process continuously, as described in U.S. Pat. No. 8,870,972. As such, transfer printing has not been a suitable alternative to aqueous bath dyeing, and is not used commercially for dyeing rolled goods or in other large-scale fabric dyeing operations. Transfer printing is instead limited mainly to producing images (patterns, lettering, logos, photographs and other artwork) on fabrics that have already been colored in a bath dyeing process or on an undyed, white background Investigation into the problem of applying a hydrophobic coating onto a conventionally-dyed fabric has revealed to the present inventors that it is related to residue chemicals used in the water-based dye process. Surfactants and other additives in the dye bath tend to deposit onto the dyed fabric and remain there if the fabric is not adequately washed. These chemicals, being generally hydrophilic in nature, appear to interfere with the application or performance of the hydrophobic treatment.

Thus, the problem can be partially remediated by thoroughly washing the fabric before applying the hydrophobic treatment. But this solution only increases the amount of waste stream that is generated. It also increases costs and ties up cleaning equipment, reducing its productivity. Therefore, this solution is not favored.

What is wanted instead is an alternative to aqueous bath dyeing. The alternative process should be efficient from energy and raw materials standpoints; be capable of dying rollstock or other large quantities of fabric at high rates; be capable of dyeing the fabric uniformly and consistently; avoid the use of large amounts of hydrophilic chemicals, and avoid using large quantities of liquids that have to be disposed of or cleaned after use. As an environmentally-benign process is sought, the process should not involve volatile organic compounds (VOCs).

The process should produce a dyed fabric that is readily and consistently coated with a hydrophobic treatment, without the need to wash the dyed fabric prior to applying a DWR coating. The non-polar nature of hydrophobic treatments such as described in WO 2015/127479 and WO 2017/020018 renders them more prone to penetrate into synthetic fiber yarns, because the fiber itself is non-polar. This is observed to be the case, resulting in better wear-resistance and laundry durability for WO 2015/127479 and WO 2017/020018, as compared to other water-based finishing processes. Nonetheless, the use of water-based dye processes compromise the performance of those hydrophobic treatments. It is desired to develop a dye process to precede the DWR (durable water-repellent) process, which does not compromise the performance of a subsequently-applied hydrophobic treatment.

This invention is in one aspect a fabric dyeing process comprising the steps of:

A. at a temperature of 10 to 100° C., applying a fluid dye composition using a non-immersive method to at least one surface of a fabric at an application weight of 2.5 to 250 grams of the dye composition per square meter of fabric, wherein the dye composition comprises a) a carrier phase that is liquid in the temperature range of 20° C. to 220° C.; said carrier phase having dissolved or suspended therein b) 2.5 to 300 grams, per liter of the dye composition, of at least one organic dye that is solid at temperatures below 130° C., and has a sublimation or melting temperature of 130° C. to 220° C., and B. curing the dye composition by heating the fabric with the applied dye composition to a temperature at least equal to the boiling or sublimation temperature of the at least one organic dye for a period of at least 30 seconds, such that the dye boils or sublimes and at least a portion thereof by comes absorbed by, diffuses into and/or becomes chemically bonded to the fabric, wherein the dye composition contains no more than 5% by weight water, no more than 5% by weight of volatile organic compounds and no more than 2.5% by weight of vinyl monomers, and the dye composition has a viscosity of at least 50 centistokes to at most 5000 centistokes at 25° C.

This invention offers many advantages. Both the dye application step (step A) and the curing step (step B) can be performed continuously although, as explained below, the curing step can also be performed batch-wise in some embodiments of the invention. When both steps A and B are operated continuously, the process is fast and requires only short residence times in the operating equipment. In some embodiments, operating equipment itself is not specialized, inexpensive and readily available.

The process is essentially non-aqueous, so the disadvantages of using aqueous dye compositions—large amounts of wastes, the need to refresh the bath solution by adding dye and other chemical, the need to dry the fabric and associated energy costs—are avoided. Essentially all of the dye composition remains with the fabric, so the process produces very little waste.

Cleaning the equipment is easy and generates little waste. Coating weights are low, and as a result of this and the viscosity of the dye composition, the coated fabric exiting step A of the process is damp but there is little if any excess dye composition that drips off the fabric or transfers to operating equipment. Small amounts of dye composition that do remain on the coating equipment are easily washed or wiped off. Equipment used in the curing step may in some cases become contaminated with small amounts of the organic dye due to the sublimation or volatilization of the dye during the curing step. This can be removed thermally in most cases.

Even though the dye composition remains with the fabric, there is usually no need to wash the fabric after dyeing to remove residual surface chemicals. Similarly, "reductive cleaning", an aqueous process that is used to remove residual, uncured dyestuff, is also not needed. Instead, residual surface dye can be removed as part of the curing process or through a subsequent thermal treatment. This is an important advantage, particularly in cases in which a subsequent finish is to be applied to the fabric. For example, the dyed fabric may be subsequently treated to render it water-repellent or oil-repellent. Fabrics dyed in this process often do not require prior cleaning or rinsing before such treatments are applied.

Unlike transfer printing, this process is a true dyeing process in which the organic dye penetrates into the fibers of the fabric, rather than being primarily a surface treatment. Colors are rich, vibrant and uniform; the dyed fabrics exhibit excellent color fastness, resist bleeding and exhibit little wet or dry crocking. The dyed fabrics strongly resist fading after repeated washings. The dyed fabrics have good "hand" and other tactile properties.

Very surprisingly, uniform dyeing often is seen even when the dye composition is applied to only one side of the fabric.

In addition to these other advantages, the process is versatile. It easily permits multiple colors to be applied to a single length of fabric simply by changing the dye composition. Dyes of different colors can be applied to a fabric to form color blends.

The invention in another aspect is a fluid dye composition comprising a) a carrier phase that is liquid in the temperature range of 20° C. to 220° C. and includes at least one poly(dimethylsiloxane) which at 25° C. is a liquid at having a viscosity of at least 50 centistokes; said carrier phase having dissolved or suspended therein, b) 2.5 to 300 grams, per liter of the dye composition, of at least one organic dye that is solid at 23° C. and sublimes and/or boils at a temperature of 130° C. to 210° C., wherein the poly(dimethylsiloxane) constitutes at least 10% by volume of the dye composition and wherein the dye composition contains no more than 5% by weight water, no more than 5% by weight of volatile organic compounds and no more than 2.5% by weight of vinyl monomers, and the dye composition has a viscosity of at least 50 centistokes to at most 5000 centistokes at 25° C.

In step A of the process of this invention, the fluid dye composition applied to the fabric using a non-immersive method. By "non-immersive" method, it is meant that the fabric is not, during the dye composition application step, submerged into a bath of the dye composition. This permits the dye composition to be applied to the fabric without a need to remove excess material by, for example, padding, squeezing, vacuuming or drying. Additionally, there is no need to remove or distill liquified gases, such as $CO_2$, some of which invariably escapes to the atmosphere.

Examples of non-immersive application methods include, for example, spraying, brushing, roller coating, slot-die coating and knife coating methods. Roller coating methods, including direct and/or offset gravure coating, as well as knife coating methods (including air knife coating methods) are particular suitable.

Roller coating is performed by applying the fluid dye composition to the surface of a roller. The fabric is then contacted with the roller surface to transfer the fluid dye composition to a surface of the fabric. Gravure roller coating is a type of roller coating that uses an engraved roller to facilitate the dye transfer. The engraving controls the coating weight and also provides the best application uniformity.

When step A is performed in a gravure roller coating process, a direct, reverse or offset process can be used. In direct gravure coating, the fluid dye composition is introduced to the surface of a rotating engraved roller, such as via a pan that the roller is partially submersed in the fluid dye composition or by some other enclosure that holds the fluid dye composition against the roller. The roller generally rotates in the same direction of the movement of the fabric past the application station. A blade typically is applied against the gravure roller to wipe off any excess dye composition before the dye composition is applied to the fabric. As the roller continues to rotate, the fluid dye composition on the roller surface is introduced to the fabric at a nip point. The nip point is typically formed between the engraved roller and a backing roller or other stationary element. The dye composition is transferred to the fabric by the nip force and is also partially "pushed" into the fabric by the roller tension.

A reverse gravure coating process is similar except the gravure roller rotates in the opposite direction.

In an offset gravure coating process, an intermediate roller ("offset roller") is used to transfer the dye composition from the gravure roller to the fabric. The dye composition is transferred from the rotating gravure roller to a rotating offset roller, and from there to the fabric by passing the fabric through a nip formed by the offset roller and a backing roller or other stationary element.

In a knife coating process, a puddle of the dye composition is applied to a surface of the substrate. The fabric is passed through a coating station in which the dye composition is deposited on its top surface and the fabric with the applied dye composition is transported beneath a knife that mechanically or pneumatically gauges the dye composition to the desired coating weight. Floating knife, knife-over-roll, knife-over-fixed-table and knife-over-conveyor configurations are all suitable, as are various air knives. Typically, an excess of dye composition (sometimes referred to as a "puddle") builds up on the top surface of the fabric, on the upstream side of the knife.

Apparatus for performing gravure coating and knife coating are well known and available from many sources, such as Innovative Machine Corporation (Birmingham, Ala.), Pyradia (Saint-Hubert, Ontario), IMC (Fairfield, N.J.), Retroflex, Inc., (Wrightstown, Wis.), Yessing Machine (Taiwan) and Zimmer Klagenfurt (Austria)

The dye composition is applied to the fabric at a temperature of 10 to 100° C. A preferred temperature is 10 to 50° C. or 20 to 40° C. An especially preferred temperature is 20 to 35° C. An advantage of this invention is that the application step can be performed under ambient conditions in factory settings.

The dye composition is applied at an application weight of 2.5 to 250 grams of the dye composition per square meter of fabric (gsm). The application weight in some embodiments may be at least 5 gsm, at least 10 gsm, at least 20 gsm, and in some embodiments may be up to 200 gsm, up to 150 gsm, up to 100 gsm, up to 75 gsm, up to 60 gsm or up to 50 gsm.

The application weight and concentration of the organic dye(s) in the dye composition may be selected together such that at least 0.25 gsm, at least 0.5 gsm or at least 0.75 gsm of the organic dye is applied. In some embodiments, the amount of organic dye(s) is up to 5 gsm, up to 2.5 gsm, up to 1.5 gsm or up to 1.25 gsm.

The application of the dye composition preferably is performed continuously by continuously moving the fabric past a dye application station where the dye is applied. This may be performed by pulling the fabric through the dye application station using an apparatus such as a tenter frame, one or more drive rollers, an endless belt or similar apparatus.

A curing step is performed on the fabric with the applied dye composition. Curing is performed by heating the fabric with the applied dye composition to a temperature at least equal to the boiling or sublimation temperature of the organic dye(s) for a period of at least 30 seconds.

The curing temperature in some embodiments is at least 140° C., at least 150° C., at least 160° C. or at least 170° C., and in some embodiments is up to 210° C., up to 200° C. or up to 195° C. In some embodiments, the curing temperature is up to 200° C., and the curing step is followed by a subsequent step in which the fabric with the cured dye composition is heated to a still higher temperature, such as 210° C. to 250° C. In this last step, residual dye that is remains on the surface of the fabric is thermally removed or "burned off" by thermal decomposition and/or vaporization.

The curing time is at least 30 seconds under the temperature conditions just described. The curing time may be at least 1 minute, at least 2 minutes or at least 3 minutes and may be, for example, up to 1 hour, up to 30 minutes, up to 15 minutes, up to 10 minutes, up to 8 minutes or up to 6 minutes.

The curing step can be performed under air or inert atmosphere such as nitrogen, argon, helium or the like (or any mixture of any two or more thereof). When the curing step is performed under air, the fluid dye composition of the invention preferably has a flash point of at least 220° C. as measured by the ASTM D92 open cup method.

Heat is preferably applied using a non-contact method, i.e., one in which the heat is supplied via a heated, non-liquefied gas or radiantly instead of through contacting the fabric with a heated solid that transfers heat to the fabric.

In some embodiments, the curing step is performed at approximately atmospheric pressure or slightly below (such as, for example, at least 90 kPa absolute up to 202 kPa or up to 125 kPa absolute). In other embodiments, the curing step is performed under elevated gas pressure. The elevated gas pressure may be, for example, at least 202 kPa, at least 500 kPa or at least 700 kPa, and may be, for example, up to 10,000 kPa, up to 5000 kPa or up to 3500 kPa, all pressures being absolute. When the curing step is performed under an elevated gas pressure of 202 kPa absolute or greater, it is preferably performed under an inert gas as described before. The inert gas in any curing step superatmospheric pressure should be non-liquified (i.e., in the gaseous and not liquid or supercritical state) at the process pressure used.

In some embodiments, the curing step (B) is performed continuously. This can be done by moving the fabric through the curing station using an apparatus such as described above with regard to the dye application step.

The coating process of the invention may be performed in an integrated process in which the application of the dye composition (step A) and step B are both performed continuously, with the fabric being moved continuously though a dye application at which the dye composition is applied, and thereafter moved continuously through a curing station where the fabric and applied dye composition are subjected to curing conditions as just described. This may be performed by moving the fabric through the dye application and curing stations using a suitable apparatus as described with regard to the dye application step.

In some embodiments, curing step B is performed in an oven. In such embodiments, the fabric with applied dye composition preferably is moved continuously through the oven, the length of the oven and line speed (speed of movement of the fabric through the oven) being selected together such that the residence time of the fabric in the oven is a set forth above with regard to the curing step. The fabric with applied dye is heated to the aforementioned curing temperature in the oven. The type of oven is not particularly critical. The needed heat can be supplied, for example, by a heated gas, by a heated thermal fluid, radiantly (as through infrared lamps or other source of electromagnetic energy) or by other suitable means.

The oven preferably is operated at approximately atmospheric pressure, such as 90 kPa to 125 kPa absolute, although higher or lower gas pressures may be used. The fabric preferably is subject to little or no mechanical pressure while in the oven during the curing step. Mechanical pressure on the fabric may be, for example, no more than 70 kPa, no more than 35 kPa or no more than 15 kPa at any point in the oven. In some embodiments, the fabric during the curing step in an oven in addition may be unsupported from below, as is the case when the fabric is attached by its edges to a tenter frame.

In other embodiments, the curing step B is performed under superatmospheric pressure as described above, preferably in a closed vessel and under an inert atmosphere as described above. A suitable vessel is an autoclave or other vessel that is capable of handling the pressures. The vessel may have one or more gas ports through which gas can be introduced for pressurization. A particular vessel useful for performing step B is described in FIGS. 1, 2 and 3 of WO 2017/020018, incorporated herein by reference. The fabric after application of the dye composition may be rolled or plaited for insertion into such a reaction vessel. The fabric may be positioned onto a spindle within the reaction vessel as described in WO 2017/020018.

In a preferred process, no step of washing, of removing excess fluid such as by wringing, padding or squeezing the fabric, or of drying the fabric is performed between the dye application step A and the curing step B. An advantage of this invention is those steps are generally unnecessary because of the attributes of the dye composition and its applied weight.

Under the curing conditions the organic dye boils or sublimes and at least a portion thereof becomes absorbed by, diffuses into and/or chemically bonds to the fabric, and/or fibers that constitute the fabric, thereby producing the wanted coloration. As such, the process is of the invention is a true dyeing process rather than a coating process in which the colorant is present in a binder which forms a layer on an exterior surface of the fabric and/or constituent fibers. Typically, the carrier of the dye composition has at least partial solubility in the yarn. This is believed to allow the dye to propagate more thoroughly into the yarn than water-based surface treatments, resulting in true dyeing. Another beneficial effect is that the applied and cured dye does not interfere with the subsequent application of a hydrophobic coating.

It is believed that at least a portion of the carrier also becomes absorbed by, diffuse into and/or chemically bond to the fabric, and/or fibers that constitute the fabric. As such, there is little or no waste liquid or solid stream generated during or as a result of the curing step. A small volume of waste may be generated when cleaning the application equipment, (rollers, pans, knife blades, etc.). This waste often can be recycled for subsequent use in the process, particularly when the application equipment is cleaned with the carrier of the dye composition or a component thereof. In addition, little if any of the carrier become volatilized or discharged to the atmosphere. Dye that volatilizes and coats the inside of the equipment used to perform the curing step is easily removed by a high temperature "flash" process or by wiping.

When curing is performed in a closed vessel, it is advantageous to enclose the fabric with applied dye composition in a wrapping to minimize dye residues forming on the interior surfaces of the vessel, thereby reducing the need for subsequent cleaning. The wrapping can be an undyed length of leader fabric, a bag or other enclosure which may be deformable and is preferably permeable to gasses. When the fabric is rolled, the wrapping can be or include one or more external turns of undyed fabric, which generally suffices to reduce or eliminate escape of volatilized dye from the fabric roll.

When curing is performed in a closed vessel, it is even possible to cure fabrics coated with different dye compositions, even those having different colored dyes, simultaneously. In the case in which multiple sections of fabric, to which different colored dyes have been applied, are cured simultaneously in a single closed vessel, it is preferably to wrap each of such sections individually as just described to prevent color contamination from occurring.

In some embodiments, a single length of fabric is dyed in two or more different colors sequentially along its length. The differently-colored dye compositions can be applied continuously as described before by, for example, changing the dye composition applied at a single application station or by passing the fabric through a first application station at which a first colored dye composition is applied only to a section of the length of the fabric and then through a second application where a second colored dye composition to a second section of the length of the fabric. The fabric can be fed continuously into a curing oven and cured as before. When the fabric is to be cured in a closed vessel, it is advantageous to leave a section of the length of the fabric, intermediate to adjacent sections to which the respective dye compositions have been applied, undyed. The length of fabric can be rolled for curing in the closed vessel, the undyed sections forming one or more turns of fabric that separate the adjacent dyed sections in the roll, thereby preventing color contamination during the curing step.

The coating process of the invention is useful for dying a fabric to produce a solid color. It is also useful in various manners to produce color blends, patterns and other designs, logos and non-uniform colorations.

Color blends can be made in accordance with the process in different ways. In some embodiments, the two or more different dye compositions, which each give rise to a different dye color after curing, can be applied to the fabric, simultaneously or consecutively, and the fabric thereafter cured as before. In such embodiments, one or more of the dye compositions may be applied to one side of the fabric, and one or more of the remaining dye compositions may be applied to the opposite side of the fabric. However, it is also possible to apply all of the dye compositions to the same side of the fabric. A particularly useful way of curing the dye compositions when forming blends is to roll the fabric with applied dye compositions and then subjecting the rolled fabric to curing conditions, particularly in a closed vessel.

Another way of producing a color blend is to coat two or more fabrics with different dye compositions that after curing produce different colors. The curing step is then performed with the coated major surfaces of the fabrics in contact with either other. This can be done, for example, by stacking the fabrics and or rolling or folding them together to form a roll or stack with alternating layers of the different fabrics. Color blends form on both fabrics upon curing as described before.

One method of producing a non-uniform coloration in the fabric is in a variation of the color blending method just described. A first dye composition is applied to a fabric as before. This dye composition may be applied uniformly onto the fabric so as to produce a solid color if the fabric were to be cured by itself. A second dye composition, producing a different color, is applied to a second fabric. The second fabric has openings in its major surface. The openings may define a pattern, design or logo, be arranged randomly, or otherwise. The second fabric may be, for example, a lace or netting. The two fabrics, with applied dye compositions, are then cured simultaneously while their major surfaces are in contact with each other as described in the preceding paragraph. Color blends form at the points of contact between the two fabrics but not elsewhere, thereby producing the desired non-uniform coloration.

The dye composition includes an organic dye and a carrier phase. The dye is dispersed and/or dissolved in the carrier phase (and may be partially dispersed and partially dissolved). By "dye" it is meant any solid colorant having the thermal characteristics described here. The dye may be soluble, partially soluble or insoluble in the carrier. As used in this specification, there is no distinction between "dye" and "pigment", both of which are intended to be encompassed within the term "dye".

The dye may be present in an amount of, for example, of 2.5 to 300 grams per liter of the fluid dye composition. A preferred lower amount is at least 10 grams per liter or at least 20 grams per liter. A preferred upper amount is up to 150 grams per liter, up to 100 grams per liter or up to 80 grams per liter.

The organic dye is characterized as being a solid at a temperature below 130° C., meaning that it does not melt, degrade, boil or sublime at such temperature, being in the solid state at all lower temperatures at 1 atmosphere pressures (101 kPa). The organic dye sublimes and/or boils at a temperature of 130° C. to 210° C., preferably 140° C. to 190° C. The organic dye may or may not have a melting temperature lower than the sublimation or boiling temperatures. The so-called "sublimation dyes" are generally considered not to exhibit any such melting temperature; these are entirely useful in this invention.

In some embodiments, the organic dye has a molecular weight of 300 to 800, especially 350 to 700 or 400 to 600.

Among the suitable organic dyes include anthraquinone dyes, which are preferred, azo dyes, diphenylamine dyes, nitroarylamino dyes, coumarin dyes, methane dyes, naphthostyryl dyes, quinophthalone dyes, formazan dyes and benzodifuranone disperse dyes, having the aforementioned thermal characteristics.

Quinone dyes are characterized by having at least one quinone unit within their molecular structures, i.e., a unit having the structure I:

(I)

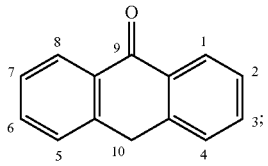

anthraquinone dyes are characterized by including within their molecular structures at least one anthraquinone unit, i.e., a unit having the structure I:

(II)

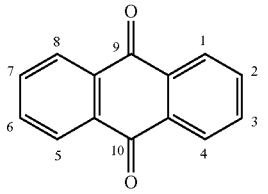

In each case one or more of carbons 1-8 and (in the case of quinone dyes) 10 are substituted with a heteroatom-containing substituent in which a heteroatom is bonded to the indicated carbon atom of the anthraquinone unit. Heteroatom-containing substitutents may be the same or different if more than one. The oxygen bonded to carbon atom 10 in structure II may be substituted with nitrogen, which may be further substituted. A wide range of such anthraquinone dyes are known; those having the aforementioned thermal characteristics are suitable for use in this invention. Among the useful quinone and anthraquinone dyes are alizarin (1,2-dihydroxy anthraquinone), oxysulfone blue, C.I. Reactive Blue 19, indanthrone (C.I. Vat Blue 4), Acid Blue 25, alizarin red S, antrapurpurin, carminic acid, 1,4-diamino-2, 3-dihydroanthraquinone, 7,14-dibenzpyrenequinone, dibromoanthathrone, 1,3-dihydroxyanthraquinone, 1,4-dihydroxylanthraquinone, C.I. Disperse Red 9, C.I. Disperse Red 11, C.I. Disperse Red 15, C.I. Disperse Red 60 morindone, oil blue 35, oil blue A, parietin, quinizarine green SS, Remazol Brilliant Blue R, C.I. Disperse Violet4, C.I. Disperse Violet 26, Solvent Violet 13, 1,2,4-trihydroxyanthraquinone, Vat Orange I and Vat Yellow 1.

Azo dyes are characterized by having at least one R—N═N—R or R═N—NH—R unit in their molecular structure. The R groups are preferably one or more of phenyl, napthaline, anthacene,

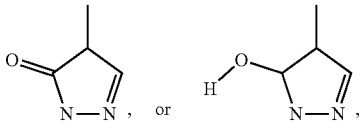

where any carbon atom of any of such R groups may be substituted or unsubstituted. Examples of azo dyes include acid orange 7, acid red 13, acid red 88, alcian yellow, allura red AC, Biebrich scarlet, Bismarck brown Y, brown HT, D&C Red 33, direct blue 1, direct blue 15, disperse orange 1, lithol rubine BK, metanil yellow, mordant brown 33, mordant red 19, oil red O, orange, orange G, orange GGN, pigment yellow 10, prontosil, red 2G, scarletGN, solvent red 26, solvent yellow 124, sudan black B, Sudan 1, Sudan II, SudanIII, Sudan IV, SudanRed 7B, Sudan Red G, Sudan stain, Sudan Yellow 3G, Sunset Yellow FCF, tartrazine, tropaeolin, trypan blue and yellow 2G.

The organic dye(s) is dispersed and/or dissolved in a carrier. The carrier consists of one or more constituent materials that when combined in form a liquid phase that has several characteristics. All components of the liquid phase of the dye composition, except for any dissolved dye, are considered for purposes of this invention as part of the carrier. It is a liquid in the temperature range of 20° C. to 220° C. The carrier is devoid of water or, if water is present, the water constitutes no more than 5% by weight of the weight of the dye composition. The carrier is devoid of volatile organic compounds (VOCs, as defined below) or, if any VOCs are present, the VOCs constitute no more than 5% by weight of the dye composition. The carrier is devoid of ethylenically unsaturated free-radical polymerizable monomers or, if such monomers are present, they constitute no more than 2.5% by weight of the dye composition. The dye composition has a viscosity of at least 50 centistokes to at most 5000 centistokes at 25° C.

In some embodiments, the carrier includes at least one polydimethylsiloxane that has a kinematic viscosity of at least 50 cst at 25° C., as measured by dynamic rotational rheology using a TA Instruments AR series rheometer or equivalent device. The polydimethylsiloxane may be linear, cyclic, branched or some combination thereof. It may have various end groups such as hydrocarbyl (methyl or other alkyl, phenyl, etc.) or functional end groups. The polydimethylsiloxane may have a kinematic viscosity of at least 90 cst, at least 300 cst or at least 350 cts and, for example, up to 5,000 cst, up to 2,000 cst or up to 1250 cst. Different polymer chain lengths in the siloxane chemistry result in different viscosities. Polysiloxanes that are not water-miscible are preferred. Herein, a material is "water-miscible" if, when mixed with water in 1:1 volume ratio at 25° C. and then left to stand unagitated at that temperature, it does not visibly phase separate from the water for at least 30 seconds.

A polydimethyl siloxane, when present, may constitute at least 10% of the weight of the fluid dye composition. In particular embodiment, the polydimethylsiloxane may constitute at least 25%, at least 50%, at least 60% or at least 75% of the weight of the fluid dye composition. It may constitute up to 98%, up to 96%, up to 95% or up to 93% of the weight thereof.

In some embodiments, the carrier includes a carboxylic acid ester having a molecular weight of up to 1000 and a flash point of at least 120° C. as determined by the ASTM D92 open cup method. The carboxylic acid ester may be, for example, i) a $C_{1-4}$ alkyl ester of a $C_{12}$-24 linear or branched alkyl, alkenyl or polyalkenyl carboxylic acid, ii) a fatty acid mono-, di- or triglyceride, or a mixture of i) and ii). For example, carboxylic acid ester i) may be a methyl, ethyl, n-propyl, isopropyl, n-butyl, isobutyl or t-butyl ester of a saturated fatty acid such as lauric acid, myristic acid, palmitic acid, stearic acid, arachidic acid, behenic acid or lignoceric acid. The carboxylic acid portion of the ester is in some embodiments linear and may be both linear and saturated. Carboxylic acid ester i) may be a methyl, ethyl, n-propyl, isopropyl, n-butyl, isobutyl or t-butyl ester of myristoleic acid, palmitoleic acid, sapienic acid, oleic acid, vaccenic acid, linoleic acid, linoelaidic acid, alpha-linolenic acid, arachidonic acid, eicosapentaenoic acid, erucic acid or docosahexaenoic acid. Isopropyl myristate is a particularly useful carboxylic acid i).

Carboxylic acid esters (ii) include mono- di- or triglycerides of fatty acids having 8 to 24, especially 8 to 18 carbon atoms, including glycerides of lauric acid, myristic acid, palmitic acid, stearic acid, arachidic acid, behenic acid, lignoceric acid, myristoleic acid, palmitoleic acid, sapienic acid, oleic acid, vaccenic acid, linoleic acid, linoelaidic acid, alpha-linolenic acid, arachidonic acid, eicosapentaenoic acid, erucic acid or docosahexaenoic acid. Among the carboxylic acid esters (ii) are plant and animal oils such as castor oil, canola oil, olive oil, linseed oil, corn oil, cottonseed oil, palm oil, peanut oil, safflower oil, sesame oil, soybean oil, sunflower oil, almond oil, beech nut oil, brazil nut oil, hazelnut oil, macadamia oil, pecan oil, pine nut oil, pistachio oil, walnut oil, pumpkin seed oil, grapefruit see oil, lemon oil, avocado oil, cocoa butter and orange oil.

The carboxylic acid ester may be a room temperature (25° C.) liquid or solid; if a solid, the carrier includes additional materials so that the mixture of materials that form the carrier is a fluid having the attributes described herein (including the restrictions on the amounts of water, VOCs and vinyl monomers).

The carboxylic acid ester, if present, may constitute at least 5%, at least 10% or at least 15% of the weight of the fluid dye composition, and may constitute up to 80%, up to 70%, up to 60% or up to 50% of the weight thereof.

The carrier in some embodiments includes both a polydimethylsiloxane and the carboxylic acid ester. In such embodiments, the polydimethylsiloxane may constitute, for example, 15 to 90%, 30 to 90% or 50 to 90% of the weight of the fluid dye composition and the carboxylic acid ester may constitute 2.5 to 75%, 2.5 to 45% or 2.5 to 35% of the weight thereof.

The carrier in some embodiments includes an organic thickener. Such thickeners should be miscible with the other components of the carrier. Examples of useful thickeners include polyacrylate polymers, guar gum, cellulose gum, xanthan gum, cellulose ethers, cellulose esters, polyvinyl alcohol, styrene-butadiene polymers and polyurethane oligomers. Such a thickener, when present, is present in an amount such that the fluid dye composition has a viscosity as set forth herein. The amount of thickener, when present, may be, for example, at least 1%, at least 5% or at least 10% of the weight of the fluid dye composition and may be, for example, up to 30%, up to 25% or up to 20% of the weight thereof.

In a particular embodiment, the carrier includes a polydimethylsiloxane, a carboxylic acid ester having a molecular weight of up to 1000 and a flash point of at least 120° C. as determined by the ASTM D92 open cup method and a thickener. In particular embodiments, the poly(dimethylsiloxane) may constitute, for example, at least 50% of the weight of the fluid dye composition; the thickener may constitute 5 to 25% of the weight of the fluid dye composition, and the carboxylic acid ester may constitute 1 to 25 weight percent of the fluid dye composition.

Another useful component of the carrier is an ethoxylated nonionic surfactant. Such a surfactant is characterized in having one or more poly(oxyethylene) chains. Examples of such surfactants include ethylene oxide/propylene oxide block copolymers; ethylene oxide/butylene oxide block copolymers, polyoxyethylene (10-100) sorbitan monocarboxylates in which the carboxylate group is a straight-chain or branched, saturated or unsaturated fatty acid residue having 8 to 24 carbon atoms; and the like. Such a surfactant, if present, may constitute up to 40% of the total weight of the fluid dye composition. A preferred amount, when present, is 2 to 40% or 2 to 20% on the same basis.

The fluid dye composition contains no more than 5% water, based on total weight of the dye composition. A preferred amount is no more than 1%, no more than 0.5% or no more than 0.25% on the same basis, and the fluid dye composition may be devoid of water.

The fluid dye composition contains no more than 5% by weight of volatile organic compounds (VOCs). By "VOC", it is meant any carbon-containing compound having a boiling temperature at 1 atmosphere (101.3 kPa) pressure of 120° C. or lower and which participates in atmospheric photochemical reaction, but not any such compound that is exempted under US Code of Federal Regulation 40 CFR § 51.100 (s) (1) as of the filing date hereof. The fluid dye composition preferably contains no more than 2% by weight thereof and more preferably no more than 1% by weight thereof, and may be devoid thereof.

In addition, the fluid dye composition contains no more than 2.5% by weight of vinyl monomers, based on the weight of the fluid dye composition. It may contain no more than 1% by weight thereof or no more than 0.5% or 0.25% by weight thereof on the same basis, and may be devoid of such vinyl monomers. By "vinyl monomers", it is meant compounds having a —CR═CH2 group, where R is hydrogen, or a group bonded to the indicated carbon atom through another carbon atom to form a carbon-carbon bond. Vinyl monomers include, for example, vinyl aromatic compounds, alpha-olefins, acrylic and acrylate monomers, methacrylic and methacrylate monomers, acrylamide, vinyl alcohol, vinyl halides, and vinyl esters.

The fluid dye composition preferably contains no more than 2.5% by weight of a wax (such as a polyethylene wax, bees wax, lanolin, carnauba wax, candelilla wax, ouricury wax, sugarcane wax, jojoba wax, epicuticular wax, coconut wax, petroleum wax, paraffin wax and the like), having a melting temperature of greater than 22° C., based on the weight of the fluid dye composition. It may contain no more than 1% by weight thereof or no more than 0.5% or 0.25% by weight thereof on the same basis.

The fluid dye composition preferably contains no more than 0.1% by weight of a free radical initiator and may be devoid of a free radical initiator.

The fluid dye composition may include other ingredients not mentioned above such as one or more organic compounds having a boiling temperature above 120° C. at one atmosphere pressure not included in any of the foregoing categories of carrier ingredients; and/or one or more organic compounds that are liquids at 25° C., have a boiling temperature of 30 to 120° C. at one atmosphere pressure and are exempted under US Code of Federal Regulation 40 CFR § 51.100 (s) (1) as of the filing date hereof. Examples of such optional ingredients include acetone, methylene chloride, methyl formate, 2-amino-2-methyl-1-propanol; t-butyl acetate; propylene carbonate, dimethyl carbonate, methyl acetate. Such other ingredients may constitute, for example, up to 35%, up to 25%, up to 15%, up to 10%, up to 5%, up to 2.5% or up to 1% of the total weight of the fluid dye composition, again provided that the dye composition has the attributes set forth herein.

In some embodiments, the fluid dye composition contains no more than 10%, no more than 5%, no more than 2% or no more than 1% by weight, of chemicals that are water-miscible as described herein, based on the total weight of the fluid dye composition.

The fluid dye composition of the invention preferably has a flash point of at least 220° C. as measured by the ASTM D92 open cup method.

The fabric is a textile that preferably is fibrous. By "fibrous", it is meant that a surface of the textile is made up of or includes filaments or fibers of at least one type. The filaments may have deniers of, for example, 0.25 to 1000, preferably 0.5 to 600 or 0.75 to 300. The filaments may form yarns. Filaments and/or yarns of the porous substrate may be, for example, woven, knitted, entangled, knotted, felted, glued or otherwise formed into a fabric, non-woven or textile having sufficient mechanical integrity to be carried through the process of the invention. Such a fabric includes fibers that may be, for example, a natural fiber such as cotton, hemp, wool, linen, silk, tencel, rayon, leather, bamboo, cellulose and the like, or a synthetic fiber such as nylon, para- or meta-aramid, polypropylene, polyester (including PET), polyacetate, polyacrylic, polylactic acid, cellulose ester or other fiber and blends of any two or more of the above. It may a smooth or fleeced fabric and it may contain a minor (up to 50%, preferably up to 20% or up to 3% by weight) of a stretchable fiber, such as Elastane, Lycra, or a polyether-polyurea polymer such as Spandex.

The invention is particularly suitable for dyeing synthetic fabrics such as, for example, polyester fabrics, polyester blends (such as nylon/polyether-polyurea copolymer blends), polyamide (including nylon) fabrics, polyamide blends (such as nylon/polyether-polyurea copolymer blends), cotton/polyamide blends such as cotton nylon blends, cotton/polyamide/polyether-polyurea blends, cotton/polyester blends, and cotton/polyester/polyether-polyurea blends.

The fabric may have, prior to dying in accordance with the invention, an air permeability of at least 0.2 cubic foot/minute/square foot (0.001016 m/s) as measured according to ASTM D737, using a Textest FX 3300 instrument and a 38 $cm^2$ test area. More preferably, the fabric has an air permeability of at least 10 (0.0508), at least 50 (0.204), at least 75 (0.3060) or at least 130 (0.6604) feet/minute/square foot (m/s). The air permeability of the porous fabric may be any higher value, such as up to 200 cubic feet/minute/square foot (1.016 m/s).

The invention is particularly suitable for treating textile rollstocks. When the textile is in the form of a sheet or rollstock, it should have a thickness of no greater than about 12 mm, and preferably has a thickness of no greater than 4 mm or no greater than 2 mm. The textile can have any smaller thickness provided it has enough mechanical integrity to be conducted through the process. The fluid dye composition in some embodiments is applied onto textile roll goods that may have widths of 100 mm or more, such as 1600 mm up to 7 meters or more.

The process is not limited to rollstock fabrics. Folded or unfolded textile sheets can be used as the substrate, as can finished articles that have a textile component. The invention is useful for applying coatings to articles of clothing such as shirts, pants, sweaters, coats, sweatshirts, gloves, hats, scarfs, leg- and arm-warmers and stockings, as well as shoes and other footwear, curtains, bedding and other textile materials.

Fabrics dyed in accordance with the invention exhibit rich, vibrant colors. Color uniformity is readily achieved.

The dyed fabrics exhibit excellent color fastness. The dyed fabrics often achieve a color fastness to dry crocking rating (AATCC 8 method) of at least 3.5, at least 4.0 or at least 4.5 and a wet crocking rating (AATCC 8 method) of at least 3.0 and often at least 4.0 or at least 4.5.

The dyed fabrics often exhibit a color fastness to water (color change) rating of at least 4.0 and often at least 4.5 when tested according to ISO 105-E01. On the same test, the dyed fabrics often exhibit a color staining rating of at least 3.5, at least 4.0 or at least 4.5 against an acetate, cotton, nylon, polyester, acrylic and wool multifiber fabric.

The dyed fabrics often exhibit a color fastness to washing (color change) rating (AATCC 61-2A) of at least 4.0 and often at least 4.5. On the same test, the dyed fabrics often exhibit a color staining rating of at least 3.5, at least 4.0 or at least 4.5 against an acetate, cotton, nylon, polyester, acrylic and wool multifiber fabric.

The dyed fabrics often exhibit a color fastness to perspiration (color change) rating (ISO 105-E04 acid test) of at least 4.0 and often at least 4.5. On the same test, the dyed fabrics often exhibit a color staining rating of at least 3.5, at least 4.0 or at least 4.5 against an acetate, cotton, nylon, polyester, acrylic and wool multifiber fabric.

The dyed fabrics often exhibit a color fastness to perspiration (color change) rating (ISO 105-E04 alkaline test) of at least 4.0 and often at least 4.5. On the same test, the dyed fabrics often exhibit a color staining rating of at least 3.5, at least 4.0 or at least 4.5 against an acetate, cotton, nylon, polyester, acrylic and wool multifiber fabric.

The dyed fabrics often exhibit an appearance rating (LTD-37 test) of at least 4.0 and often at least 4.0 or at least 4.5 after 10 washes, after 15 washes, after 20 washes and even after 25 washes.

The dyed fabric may be subsequently treated with various treatments as may be desirable or necessary for its intended end-use. Examples of such treatments include hydrophobic treatments, to impart water repellency and/or hydrophobic characteristics; oleophobic treatments, to decrease fat and oil absorbency or staining and/or to impart repellency to fats and oils; super-hydrophobicity treatments impart very high) (>130° contact angles of a water droplet with a surface of the treated substrate; hydrophilic treatments, to increase water absorption or wetting; various sizings; flame retardant treatments; antimicrobial treatments; UV absorber and/or UV reflector treatments; wrinkle-resisting agents; fabric softeners and/or anti-chafing treatments; emollient treatments; insecticide and/or insect repellant treatments, forensic chemical marker treatments.

In particular, it has been found that fabrics dyed in accordance with the invention can be easily and effectively treated with a hydrophobic treatment. Such a hydrophobic treatment is suitably applied and cured, if necessary, after the fabric has been dyed and the dye has been cured in accordance with the process of this invention. Particularly useful hydrophobic treatments include those described in WO 2015/127479 and WO 2007/020018, especially a hydrophobic treatment that includes i) a silicone oil, ii) at least one free-radical-curable monomer having exactly one polymerizable group per molecule, the free-radical-curable monomer having at least one hydrocarbyl group that has at least eight carbon atoms bonded directly or indirectly to the polymerizable group, wherein the hydrocarbyl group may be nonfluorinated, partially fluorinated or perfluorinated, the free-radical-curable monomer having a boiling temperature equal to or greater than 100° C., iii) at least one crosslinking monomer having at least two free-radical-curable polymerizable groups and a boiling temperature equal to or greater than 100° C. and optionally iv) at least one wax. A very significant advantage of this invention is that the subsequent hydrophobic treatment can be applied to the dyed and cured fabric without any intervening step of washing the fabric and without the adverse effects of conventionally-finished, water-based dyeing.

The following examples are intended to illustrate the invention but not to limit the scope thereof. All parts and percentages are by weight unless otherwise indicated.

EXAMPLE 1

A fluid dye composition is prepared by mixing, in a laboratory mixer, 2 parts of an anthraquinone dye (Red 70027 from Continental Red), 30 parts of 1000 cst poly (dimethylsiloxane) (PDMS), 8 parts of guar gum, and 1.5 parts of isopropyl myristate. This fluid dye composition is then used to dye a high tenacity (HT) woven polyester fabric. HT fabric is one of the hardest fabrics to dye using conventional, water-based dyeing. Additionally, it is well known in the art that red dyes tend to be the most difficult dyes to use due to increased crocking and colorfast issues.

The polyester fabric is mounted on a tenter frame, being secured on the selvage on each side by pins on the tenter frame. The so-mounted fabric is then pulled past a dye application station at which the fluid dye composition is poured onto the fabric just upstream of a knife-and-roller type knife blade apparatus. The knife blade apparatus is adjusted to gauge the coating weight to 30 to 60 grams per square meter. The coating is performed at 25±3° C. A uniform coating of the fluid dye composition is applied across the width of the fabric. Importantly, at the time of application, the fluid dye composition does not pass through the fabric at the coating station and contact the underlying roller.

The tenter frame then transports continuously the fabric with applied fluid dye composition into a multi-zone, atmospheric oven under air, without any intervening processing steps (such as padding, drying, washing, etc). The zone temperatures are set at 195° C. with a final zone at 210° C. The line speed is selected such that the residence time in the 195° C. zones of the zone is 4 minutes, and the residence time in the 210° C. zone is one minute.

The fluid dye composition cures in the 195° C. zones of the oven. In the 210° C. zone of the oven, residual dyestuff residing on the surface of the fabric is thermally removed. This eliminates any dry crocking issues and also removes the need for rinsing before a subsequent hydrophobic treatment is applied. The fabric is then cooled and rolled up with no further processing (in particular, without rinsing or washing) prior to applying a hydrophobic treatment.

Even though the fluid dye composition does not penetrate through the fabric during the initial application step, the cured fabric is dyed on both sides with no detectable shade difference between front and back.

A hydrophobic treatment is applied to the dyed fabric. The hydrophobic treatment includes a mixture of octadecyl acrylate, 1,6-hexanediol diacrylate, dipentaerythritol penta/hexa acrylate, lauroyl acrylate and a polydimethylsiloxane. The DWR treatment applied 15 gsm (grams per sq meter) of chemistry. The hydrophobic treatment is applied to each side of the fabric at a coating weight of 15 grams per square meter using a gravure roller. The coated fabric is rolled onto a beam and then cured under 500 psi (3.447 MPa) pressure of nitrogen at 100° C. for 30 min, following the procedure outlined in U.S. Pat. No. 9,902,874.

The dyed fabric is evaluated for color fastness to crocking (wet and dry) according to AATCC 8; color fastness to water according to ISO 105-E01, color fastness to washing according to AATCC 6121), color fastness to perspiration (acid and alkaline) according to ISO 105-E04, and appearance after washing for 25 washes according to LTD-37. Results are as indicated in Table 1. Industry standards are indicated in the "Requirements" column for reference.

The water repellency performance and the laundry durability of the DWR treatment applied after the water-free dye process is also tested using the AATCC 22 Spray Test (scale 0 to 100) and the Bundesmann ISO 9865 water repellency test (scale 1-5). Industry "best practices" call for an ISO 9865 rating of 2.5 after 3 washes. There is no standard for more than 3 washes because no previous DWR process can provide an ISO 9865 rating beyond 1 for more than 3 washes. The results show high performance (at least a 2.5 rating) through 10 washes and even beyond. All conventionally dyed fabrics with subsequent DWR treatment fail the ISO 9865 test at 5 or higher washes.

TABLE 1

| Test Standard | | | Requirement | Test Result |
|---|---|---|---|---|
| CF to crocking (AATCC 8) | Dry | | 4.0 | 4.5 |
| | Wet | | 3.0 | 4.5 |
| CF to water (ISO 105-E01) | Color change | | 4.0 | 4.5 |
| | Color staining | Acetate | 3.5 | 4.5 |
| | | Cotton | | 4.5 |
| | | Nylon | | 4.5 |
| | | Polyester | | 4.5 |
| | | Acrylic | | 4.5 |
| | | Wool | | 4.5 |
| CF to washing (AATCC 61-2A) | Color change | | 4.0 | 4.5 |
| | Color staining | Acetate | 3.5 | 4.5 |
| | | Cotton | | 4.5 |
| | | Nylon | | 4.5 |
| | | Polyester | | 4.5 |
| | | Acrylic | | 4.5 |
| | | Wool | | 4.5 |
| CF to perspiration (ISO 105-E04) Acid | Color change | | 4.0 | 4.5 |
| | Color staining | Acetate | 3.5 | 4.5 |
| | | Cotton | | 4.5 |
| | | Nylon | | 4.5 |
| | | Polyester | | 4.5 |
| | | Acrylic | | 4.5 |
| | | Wool | | 4.5 |
| CF to perspiration (ISO 105-E04) Alkaline | Color change | | 4.0 | 4.5 |
| | Color staining | Acetate | 3.5 | 4.5 |
| | | Cotton | | 4.5 |

TABLE 1-continued

| Test Standard | | Requirement | Test Result |
|---|---|---|---|
| | | Nylon | 4.5 |
| | | Polyester | 4.5 |
| | | Acrylic | 4.5 |
| | | Wool | 4.5 |
| Appearance | 5 washes | 4.0 | 4.5 |
| after repeated | 10 washes | 4.0 | 4.0 |
| home | 15 washes | 4.0 | 4.0 |
| laundering | 20 washes | 4.0 | 4.0 |
| (LTD-37) | 25 washes | 4.0 | 4.0 |

The water repellency performance and the laundry durability of the DWR treatment applied after the water-free dye process is also tested using the AATCC 22 Spray Test (scale 0 to 100) and the Bundesmann ISO 9865 water repellency test (scale 1-5). Industry "best practices" call for an ISO 9865 rating of 2.5 after 3 washes. There is no standard for more than 3 washes because no previous DWR process can provide an ISO 9865 rating beyond 1 for more than 3 washes. The results show high performance (at least a 4.2 rating) through 10 washes with a 100 spray rating on the AATCC 22 Spray Test, with 12-13 mL of water passing through the fabric. Conventionally dyed fabrics with subsequent DWR treatment fail the ISO 9865 test at 5 or higher washes.

In specific embodiments, the invention is:

1. A fabric dyeing process comprising the steps of:

A. at a temperature of 10 to 100° C., applying a fluid dye composition using a non-immersive method to at least one surface of a fabric at an application weight of 2.5 to 250 grams of the dye composition per square meter of fabric, wherein the dye composition comprises a) a carrier phase that is liquid in the temperature range of 20° C. to 220° C.; said carrier phase having dissolved or suspended therein b) 2.5 to 300 grams, per liter of the dye composition, of at least one organic dye that is solid at temperatures below 130° C. and has a sublimation or boiling temperature of 130° C. to 220° C., and B. curing the dye composition by heating the fabric with the applied dye composition to a temperature at least equal to the boiling or sublimation temperature of the at least one organic dye for a period of at least 30 seconds, such that the dye boils or sublimes and at least a portion thereof penetrates into the fabric, wherein the dye composition contains no more than 5% by weight water, no more than 5% by weight of volatile organic compounds and no more than 2.5% by weight of vinyl monomers, and the dye composition has a viscosity of at least 50 centistokes to at most 5000 centistokes at 25° C.

2. A fabric dyeing process as in embodiment 1 wherein the dye composition contains no more than 10% of chemicals that are water-miscible.

3. A fabric dyeing process as in embodiment 1 or 2 wherein in step A the fabric is moved continuously through a dye application station where the dye composition is applied to the fabric.

4. A fabric dyeing process as in any of embodiments 1-3 wherein in step B the fabric is moved continuously through a heating station where the fabric with the applied dye composition is heated to a temperature of 140 to 220° C. for a period of at least 30 seconds.

5. A fabric dyeing process as in embodiment 4 wherein in step B the fabric is affixed at opposing edges to a tenter frame, which tenter frame moves the fabric continuously through the heating station.

6. A fabric dyeing process as in any preceding embodiment wherein in step B the fabric is unsupported from beneath and no mechanical pressure is applied to a top surface of the fabric.

7. A fabric dyeing process as in any preceding embodiment wherein in step A the dye is applied with a gravure coater.

8. A fabric dyeing process as in any of embodiments 1-3 wherein the fabric with applied dye composition is formed into a roll, and step B is performed on the roll in a closed vessel.

9. A fabric dyeing process as in embodiment 8 wherein during at least a portion of step B the closed vessel is pressurized with a non-liquified gas to a gauge pressure of 350 to 7,000 kPa.

10. A fabric dyeing process as in any preceding embodiment wherein in step A the dye composition is applied at a coating weight of 5 to 50 grams/square meter.

11. A fabric dyeing process as in any preceding embodiment wherein the fabric prior to dyeing has an areal weight of 50 to 250 grams per square meter.

12. A fabric dyeing process as in any preceding embodiment wherein the fabric prior to dyeing has an air permeability of 0.472 to 23.6 L/s as measured according to ASTM D737, using a Textest FX 3300 instrument and a 38 $cm^2$ test area.

13. A fabric dyeing process as in any preceding embodiment wherein in step A the dye composition is applied to only one surface of the fabric.

14. A fabric dyeing process as in any preceding embodiment wherein in step A a first dye composition is applied to a portion of a surface of the fabric and a second dye composition is applied to a different portion of the same surface of the fabric and in step B the first and second dye compositions are simultaneously cured.

15. A fabric dyeing process as in embodiment 14 wherein the first and second dye compositions have different colors after curing.

16. A fabric dyeing process as in any of embodiments 1-12 wherein in step A a first dye composition is applied to one surface of the fabric, a second dye composition is applied to an opposing surface of the fabric and in step B the first and second dye compositions are simultaneously cured.

17. A fabric dyeing process as in embodiment 16 wherein the first and second dye compositions have different colors after curing.

18. A fabric dyeing process as in any preceding embodiment wherein the fabric is a woven or knitted fabric.

19. A fabric dyeing process as in any preceding embodiment wherein the fabric is a polyester or polyamide fabric, or a blend of a polyester or polyamide with at least one other fiber.

20. A fabric dyeing process as in any preceding embodiment further comprising, after step B, applying a water-free hydrophobic fabric treatment to the fabric.

21. A fabric dyeing process as in any preceding embodiment wherein the organic dye is an anthroquinone or azo-type dye.

22. A fabric dyeing process as in any preceding embodiment wherein the dye composition contains 20 to 150 grams, per liter of the dye composition, of the at least one organic dye.

23. A fabric dyeing process as in any preceding embodiment wherein the carrier includes at least one poly(dimethylsiloxane) which at 25° C. is a liquid at having a viscosity of at least 50 centistokes and the poly(dimethylsiloxane) constitutes at least 10% by weight of the dye composition.

24. A fabric dyeing process as in embodiment 23 wherein the poly(dimethylsiloxane) constitutes at least 50% of the volume of the dye composition.

25. A fabric dyeing process as in embodiment 23 or 24 wherein the poly(dimethylsiloxane) has a viscosity of at least 100 cst at 25° C.

26. A fabric dyeing process as in embodiment 25 wherein the poly(dimethylsiloxane) has a viscosity of at least 300 cst at 25° C.

27. A fabric dyeing process as in any of embodiments 23-26 wherein the dye composition further comprises an organic thickener.

28. A fabric dyeing process as in embodiment 27 where in the thickener is selected from the group consisting of a polyacrylate polymer, guar gum, cellulose gum, xanthan gum, a cellulose ether, a cellulose ester, polyvinyl alcohol, a styrene-butadiene polymer and a polyurethane oligomer.

29. A fabric dyeing process as in any of embodiments 23-28 wherein the dye composition further comprising a carboxylic acid ester having a molecular weight of up to 1000 and a flash point of at least 120° C. as determined by the ASTM D92 open cup method.

30. A fabric dyeing process as in embodiment 29 wherein the carboxylic acid ester is i) a $C_1$-4 alkyl ester of a $C_{12}$-24 linear or branched alkyl, alkenyl or polyalkenyl carboxylic acid, ii) a fatty acid mono-, di- or triglyceride, or a mixture of i) and ii).

31. A fabric dyeing process as in embodiment 30 wherein the carboxylic acid ester is isopropyl myristate.

32. A fabric dyeing process as in embodiment 23 where the carrier includes at least 50 volume-% of the poly (dimethylsiloxane), 5 to 25 volume-% of a thickener and 1 to 25 volume-% of a carboxylic acid ester having a molecular weight of up to 1000 and a flash point of at least 120° C. as determined by the ASTM D92 open cup method.

33. A fabric dyeing process as in any of embodiments 23-32 wherein the carrier further comprises an ethoxylated nonionic surfactant.

34. A fluid dye composition comprising a) a carrier phase that is liquid in the temperature range of 20° C. to 220° C. and includes at least one poly(dimethylsiloxane) which at 25° C. is a liquid at having a viscosity of at least 50 centistokes; said carrier phase having dissolved or suspended therein b) 2.5 to 300 grams, per liter of the dye composition, of at least one organic dye that is solid at temperatures below 130° C. and sublimes and/or boils at a temperature of 130° C. to 210° C., wherein the poly(dimethylsiloxane) constitutes at least 10% by weight of the dye composition and wherein the dye composition contains no more than 5% by weight water, no more than 5% by weight of volatile organic compounds and no more than 2.5% by weight of vinyl monomers, and the dye composition has a viscosity of at least 50 centistokes to at most 5000 centistokes at 25° C.

35. A fluid dye composition as in embodiment 34 wherein the organic dye is an anthroquinone or azo-based dye.

36. A fluid dye composition as in embodiment 34 or 35 wherein water constitutes no more than 1% of the volume of the dye composition.

37. A fluid dye composition as in any of embodiments 34-36 which contains 20 to 150 grams, per liter of the dye composition, of the at least one organic dye.

38. A fluid dye composition as in any of embodiments 34-37 wherein the poly(dimethylsiloxane) constitutes at least 50% of the volume of the dye composition.

39. A fluid dye composition as in any of embodiments 34-38 wherein the poly(dimethylsiloxane) has a viscosity of at least 100 cst at 25° C.

40. A fluid dye composition as in any of embodiments 34-39 wherein the poly(dimethylsiloxane) has a viscosity of at least 300 cst at 25° C.

41. A fluid dye composition as in any of embodiments 34-40, further comprising an organic thickener.

42. A fluid dye composition as in embodiment 41 where in the thickener is selected from the group consisting of a polyacrylate polymer, guar gum, cellulose gum, xanthan gum, a cellulose ether, a cellulose ester, polyvinyl alcohol, a styrene-butadiene polymer and a polyurethane oligomer.

43. A fluid dye composition as in any of embodiments 34-42, further comprising a carboxylic acid ester having a molecular weight of up to 1000 and a flash point of at least 120° C. as determined by the ASTM D92 open cup method.

44. A fluid dye composition as in embodiment 43 wherein the carboxylic acid ester is i) a $C_1$-4 alkyl ester of a $C_{12}$-24 linear or branched alkyl, alkenyl or polyalkenyl carboxylic acid, ii) a fatty acid mono-, di- or triglyceride, or a mixture of i) and ii).

45. A fluid dye composition as in embodiment 44 wherein the carboxylic acid ester is isopropyl myristate.

46. A fluid dye composition as in any of embodiments 34-45 where the carrier includes at least 50 weight-% of the poly(dimethylsiloxane), 5 to 25 weight-% of a thickener and 1 to 25 weight-% of a carboxylic acid ester having a molecular weight of up to 1000 and a flash point of at least 120° C. as determined by the ASTM D92 open cup method.

47. A fluid dye composition as in any of embodiments 34-46 wherein the carrier further comprises an ethoxylated nonionic surfactant.

What is claimed is:

1. A fabric dyeing process comprising the steps of:

A. at a temperature of 10 to 100° C., applying a fluid dye composition using a non-immersive method to at least one surface of a fabric at an application weight of 2.5 to 250 grams of the dye composition per square meter of fabric, wherein the dye composition comprises a) a carrier phase that is liquid in the temperature range of 20° C. to 220° C.; said carrier phase having dissolved or suspended therein b) 2.5 to 300 grams, per liter of the dye composition, of at least one organic dye that is solid at temperatures below 130° C. and has a sublimation or boiling temperature of 130° C. to 220° C., and B. curing the dye composition by heating the fabric with the applied dye composition to a temperature at least equal to the boiling or sublimation temperature of the at least one organic dye for a period of at least 30 seconds, such that the dye boils or sublimes and at least a portion thereof penetrates into the fabric, wherein the dye composition contains no more than 5% by weight water, no more than 5% by weight of volatile organic compounds and no more than 2.5% by weight of vinyl monomers, and the dye composition has a viscosity of at least 50 centistokes to at most 5000 centistokes at 25° C., wherein in step A the fabric is moved continuously through a dye application station where the dye composition is applied to the fabric and the dye is applied with a gravure coater.

2. The fabric dyeing process of claim 1 wherein in step B the fabric is moved continuously through a heating station where the fabric with the applied dye composition is heated to a temperature of 140 to 220° C. for a period of at least 30 seconds.

3. The process of claim 1 wherein in step A the dye composition is applied at a coating weight of 5 to 50 grams/square meter.

4. The process of claim 1 wherein in step A a first dye composition is applied to a portion of a surface of the fabric and a second dye composition is applied to a different portion of the same surface of the fabric and in step B the first and second dye compositions are simultaneously cured.

5. The process of claim 4 wherein the first and second dye compositions have different colors after curing.

6. The process of claim 1 wherein in step A a first dye composition is applied to one surface of the fabric, a second dye composition is applied to an opposing surface of the fabric and in step B the first and second dye compositions are simultaneously cured.

7. The process of claim 6 wherein the first and second dye compositions have different colors after curing.

8. The process of claim 1 further comprising, after step B, applying a hydrophobic fabric treatment to the fabric.

9. The process of claim 1 wherein the carrier includes at least one poly(dimethylsiloxane) which at 25° C. is a liquid at having a viscosity of at least 50 centistokes and the poly(dimethylsiloxane) constitutes at least 10% by weight of the dye composition.

10. The process of claim 9 wherein the dye composition further comprises an organic thickener.

11. The process of claim 9 wherein the dye composition further comprising a carboxylic acid ester having a molecular weight of up to 1000 and a flash point of at least 120° C. as determined by the ASTM D92 open cup method, wherein the carboxylic acid ester is i) a $C_{1-4}$ alkyl ester of a $C_{12-24}$ linear or branched alkyl, alkenyl or polyalkenyl carboxylic acid, ii) a fatty acid mono-, di- or triglyceride, or a mixture of i) and ii).

12. A fabric dyeing process comprising the steps of:

A. at a temperature of 10 to 100° C., applying a fluid dye composition using a non-immersive method to at least one surface of a fabric at an application weight of 2.5 to 250 grams of the dye composition per square meter of fabric, wherein the dye composition comprises a) a carrier phase that is liquid in the temperature range of 20° C. to 220° C.; said carrier phase having dissolved or suspended therein b) 2.5 to 300 grams, per liter of the dye composition, of at least one organic dye that is solid at temperatures below 130° C. and has a sublimation or boiling temperature of 130° C. to 220° C., and B. curing the dye composition by heating the fabric with the applied dye composition to a temperature at least equal to the boiling or sublimation temperature of the at least one organic dye for a period of at least 30 seconds, such that the dye boils or sublimes and at least a portion thereof penetrates into the fabric, wherein the dye composition contains no more than 5% by weight water, no more than 5% by weight of volatile organic compounds and no more than 2.5% by weight of vinyl monomers, and the dye composition has a viscosity of at least 50 centistokes to at most 5000 centistokes at 25° C., wherein in step A the fabric is moved continuously through a dye application station where the dye composition is applied to the fabric, the fabric with applied dye composition is formed into a roll, and step B is performed on the roll in a closed vessel.

13. The process of claim 12 wherein during at least a portion of step B the closed vessel is pressurized with a non-liquified gas to a gauge pressure of 350 to 7,000 kPa.

* * * * *